US009068335B2

(12) United States Patent
Butler et al.

(10) Patent No.: US 9,068,335 B2
(45) Date of Patent: Jun. 30, 2015

(54) VALVE OPERATING NUT PROTECTOR

(75) Inventors: Don Butler, Sullivan, IL (US); Eric Jackson, Poquoson, VA (US)

(73) Assignee: Hampton Roads Sanitation District, Virginia Beach, VA (US)

( * ) Notice: Subject to any disclaimer, the term of this patent is extended or adjusted under 35 U.S.C. 154(b) by 725 days.

(21) Appl. No.: 13/314,163

(22) Filed: Dec. 7, 2011

(65) Prior Publication Data

US 2012/0138160 A1 Jun. 7, 2012

Related U.S. Application Data

(60) Provisional application No. 61/420,770, filed on Dec. 7, 2010.

(51) Int. Cl.
*E03B 9/12* (2006.01)
*E03F 3/04* (2006.01)

(52) U.S. Cl.
CPC .... *E03F 3/04* (2013.01); *E03B 9/12* (2013.01)

(58) Field of Classification Search
CPC ..... E03B 9/10; E03B 9/12; E03F 3/04
USPC ..... 137/363, 365, 366, 382.5, 368, 371, 137/377, 382, 364
See application file for complete search history.

(56) References Cited

U.S. PATENT DOCUMENTS

| | | | | |
|---|---|---|---|---|
| 2,008,138 | A * | 7/1935 | Le Duc | 137/366 |
| 2,118,233 | A * | 5/1938 | Ruggio | 137/296 |
| 3,548,864 | A * | 12/1970 | Perry et al. | 137/364 |
| 4,534,378 | A * | 8/1985 | Gagas et al. | 137/367 |
| 4,556,081 | A * | 12/1985 | Gagas | 137/366 |
| 4,572,236 | A * | 2/1986 | Baker | 137/364 |
| 4,819,687 | A * | 4/1989 | Alberico et al. | 137/367 |
| 6,354,325 | B1 * | 3/2002 | Warnes et al. | 137/367 |
| 2008/0023076 | A1 * | 1/2008 | Weisz et al. | 137/364 |

* cited by examiner

*Primary Examiner* — Craig Schneider
*Assistant Examiner* — Nicole Wentlandt
(74) *Attorney, Agent, or Firm* — Whitham, Curtis, Christofferson & Cook, P.C.

(57) ABSTRACT

A protective assembly for an operating nut of an actuator for a valve in an underground pipe system is comprised of a guide assembly and a mounting assembly. A riser pipe is used to access the operating nut from above ground. The protective assembly maintains alignment of the riser pipe at installation and as the ground shifts over time. The guide assembly is formed of a guide structure and a mounting collar that juts outwardly from the guide structure forming a flange. The mounting assembly has a first portion for attaching the mounting assembly to the flange, and a second portion for attaching the mounting assembly to the actuator.

20 Claims, 14 Drawing Sheets

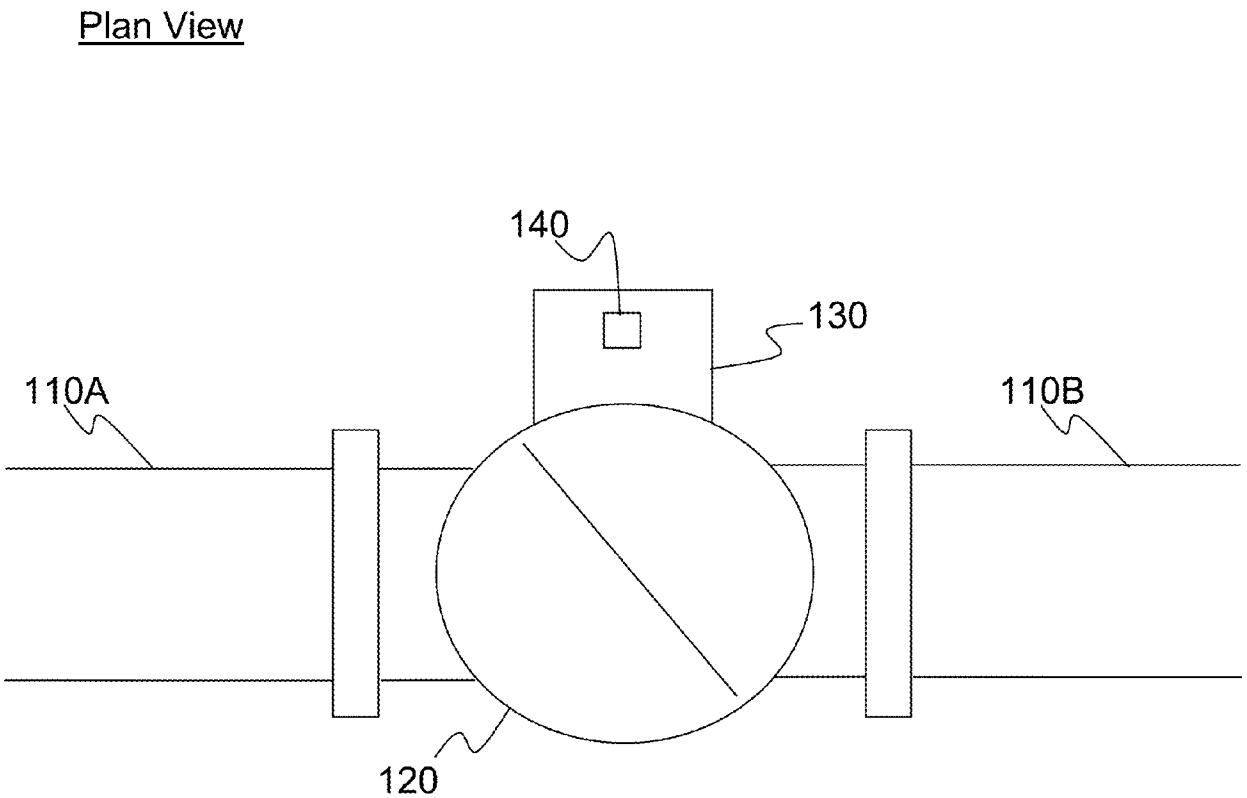
Figure 1A – PRIOR ART

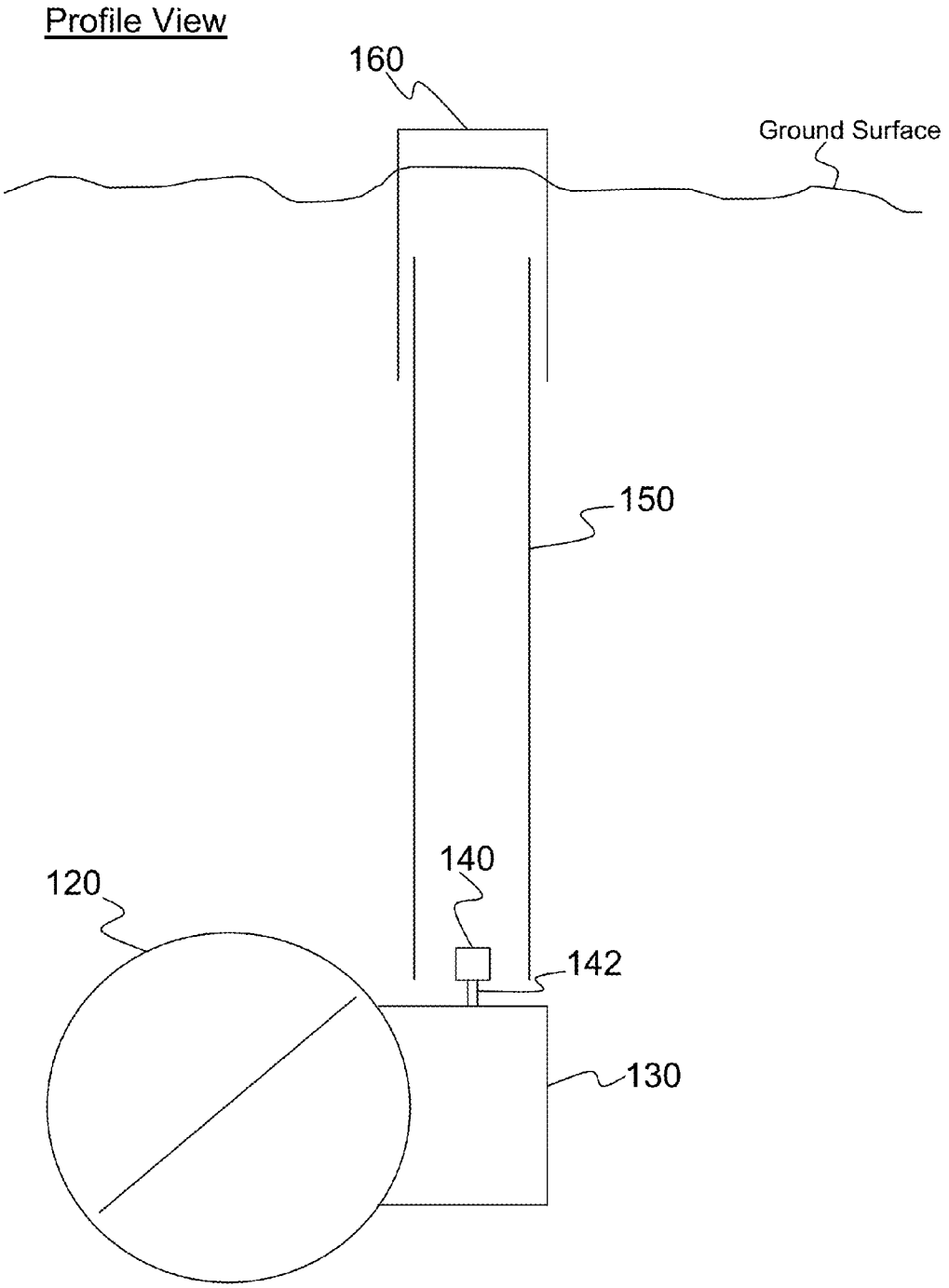
Figure 1B - PRIOR ART

VALVE OPERATING NUT PROTECTOR

This application claims priority from U.S. Provisional Patent Application No. 61/420,770 of the same title filed on Dec. 7, 2010, the contents of which are incorporated by reference herein.

BACKGROUND OF THE INVENTION

1. Field of the Invention

The present invention generally relates to the operation of valves controlling flows in pipes that have been buried underground, where the valves are accessible from above ground via a riser pipe.

2. Background Description

Underground pipes provide much of the infrastructure for water and sewer systems across the country. Maintenance on these systems requires that these pipes be built in segments 110 (A and B) separated by valves 120 that can be opened and closed as necessary by an actuator 130, as shown in FIG. 1A. Frequently the valve assemblies (120,130) are accessed for opening and closing from an above ground location via a riser pipe 150 capped by a valve box frame 160, as shown in FIG. 1B.

In order to open or close the valve it is necessary to turn an operating nut 140 at the valve assembly. This is accomplished by using a tool that is extended down through the riser pipe 150 and mounts on the operating nut 140. By turning the tool from above ground the operating nut 140 is turned, thereby opening or closing the valve, as desired.

However, the riser pipe 150 can shift or get misaligned during construction of the underground pipe system or over time as the ground around the riser pipe settles. As a result, the operating nut 140 or the stem 142 connecting the operating nut to the valve actuator 130 can be damaged.

SUMMARY OF THE INVENTION

It is therefore an object of the present invention to provide a device that can be installed at the valve assembly to protect the operating nut from being damaged by the riser pipe because of misalignment during construction or ground movement over time that shifts or misaligns the riser pipe.

Another object of the invention is to provide a protector for the operating nut that ensures alignment of the riser pipe at installation and as the ground shifts over time.

The invention is a two part assembly for protecting the valve operating nut. The first part is a protective guide assembly comprising a protective guide structure welded to a mounting collar, at least a portion of which juts outwardly from the guide structure. The second part is a mounting assembly bolted to both the mounting collar and the actuator, thereby orienting the guide structure so that its axis is approximately parallel to the stem of the operating nut and approximately centered over the valve operating nut. The protective guide assembly and the mounting assembly together comprise the nut protector assembly (also referred to simply as the "nut protector"). The riser pipe fits over the guide structure, which is hollow and with enough clearance inwardly perpendicular to its axis to accommodate a tool for turning the valve operating nut. The length of the guide structure above the mounting collar is sufficient to allow for a shift in the riser pipe upwardly from the operating nut along the axis of the guide structure, in accordance with estimated movements of the ground for a particular installation of the invention.

In one implementation of the invention, the mounting assembly is comprised of a single piece having an opening for sliding under the operating nut around the stem and being attachable to the actuator of the valve assembly. After the mounting assembly is attached to the actuator it is then attached to the mounting collar.

In another implementation of the invention, the mounting assembly is comprised of two angle braces with opposite vertical sides mounted to the actuator of the valve assembly. The outward jutting horizontal sides of the angle braces are attached to a mounting collar shaped to accommodate the outward jutting sides of the angle braces.

In one aspect, the invention provides means for guiding a riser pipe so that the riser pipe remains aligned over an operating nut, providing access to the operating nut from a ground surface. A mounting assembly is attached to a valve actuator, and a protective guide assembly is attached to the mounting assembly. In one implementation the mounting assembly is a base plate having a cutout portion for insertion of the base plate around the operating nut stem between a valve actuator and the operating nut. In another implementation the mounting assembly is comprised of angle braces whose opposite vertical sides are mounted to the valve actuator, where the horizontal sides of the angle braces form a planar platform for mounting to the guide structure assembly via a rectangular mounting collar. The guide structure is a hollow cylinder and when welded to the mounting collar provides a protective guide assembly for the operating nut.

BRIEF DESCRIPTION OF THE DRAWINGS

The foregoing and other objects, aspects and advantages will be better understood from the following detailed description of preferred embodiments of the invention with reference to the drawings, in which:

FIGS. 1A and 1B are schematic diagrams of a plan view and profile view, respectively, of a typical valve assembly installation under the prior art.

DETAILED DESCRIPTION OF PREFERRED EMBODIMENTS OF THE INVENTION

Figure 1C:
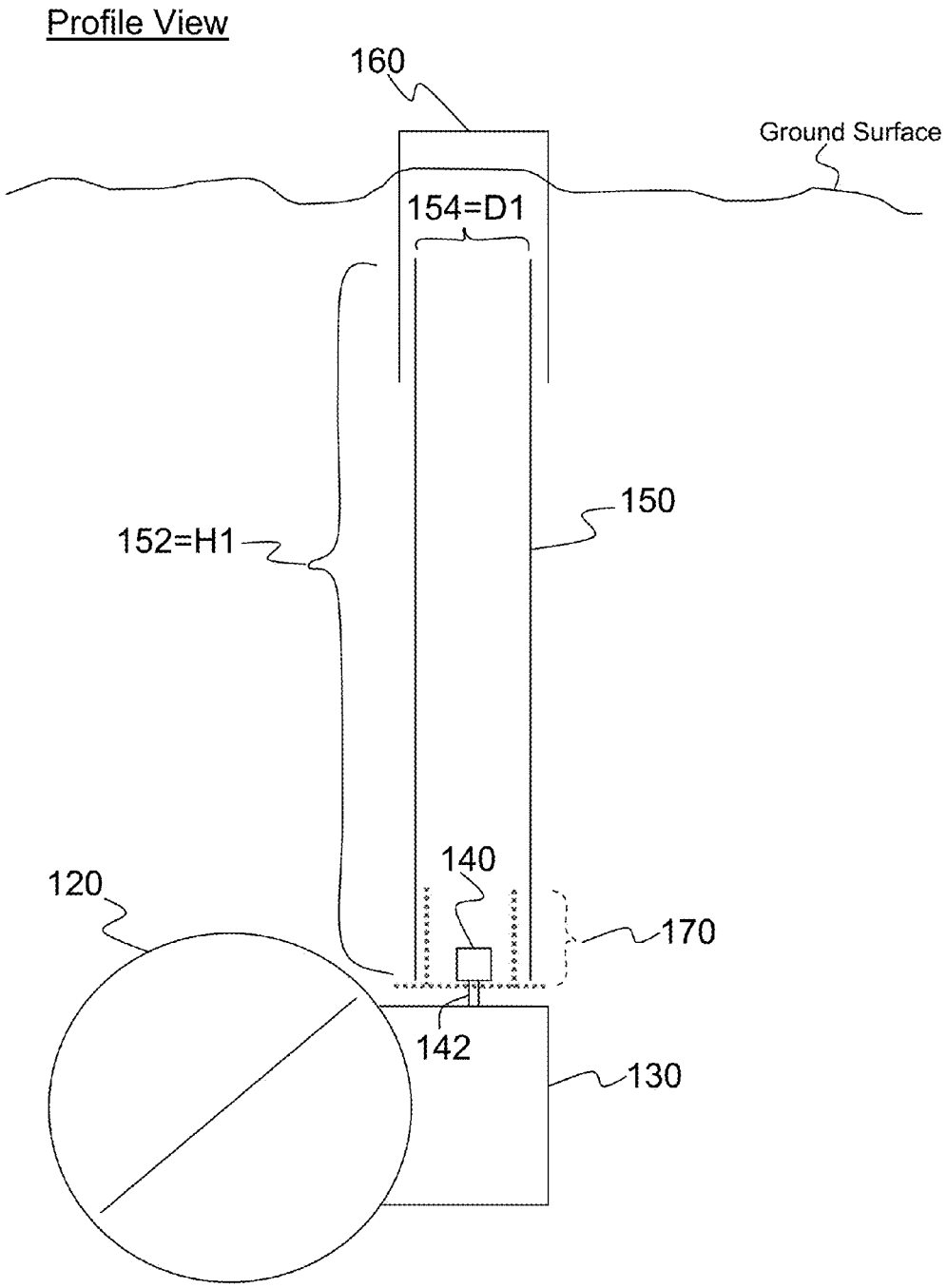
FIG. 1C is a schematic diagram as in FIG. 1B showing a schematic representation of how the invention is connected in a typical installation.

Referring now to the drawings, and more particularly to FIG. 1C, there is shown a schematic diagram of a typical installation of the invention in a large diameter pipe system. The schematic is not drawn to scale. For example, the valve 120 typically controls flow to a large diameter pipe, which could be several feet in diameter, and the riser pipe 150 is typically a PVC pipe. The valve 120 is opened and closed by actuator 130, which is operated by a two inch square operating nut 140 connected to the actuator 130 by a stem 142.

The riser pipe 150 fits over the operating nut 140 and extends to the ground surface, with the end at the ground surface being covered by a valve box frame and cover 160 that allows access to the operating nut 140 using a tool (not shown) for turning the operating nut 140 to open or close the valve 120. The guide protective assembly 170 fits over the operating nut and is attached to the actuator 130 by means of a mounting assembly (not shown in FIG. 1C).

Figure 1D:
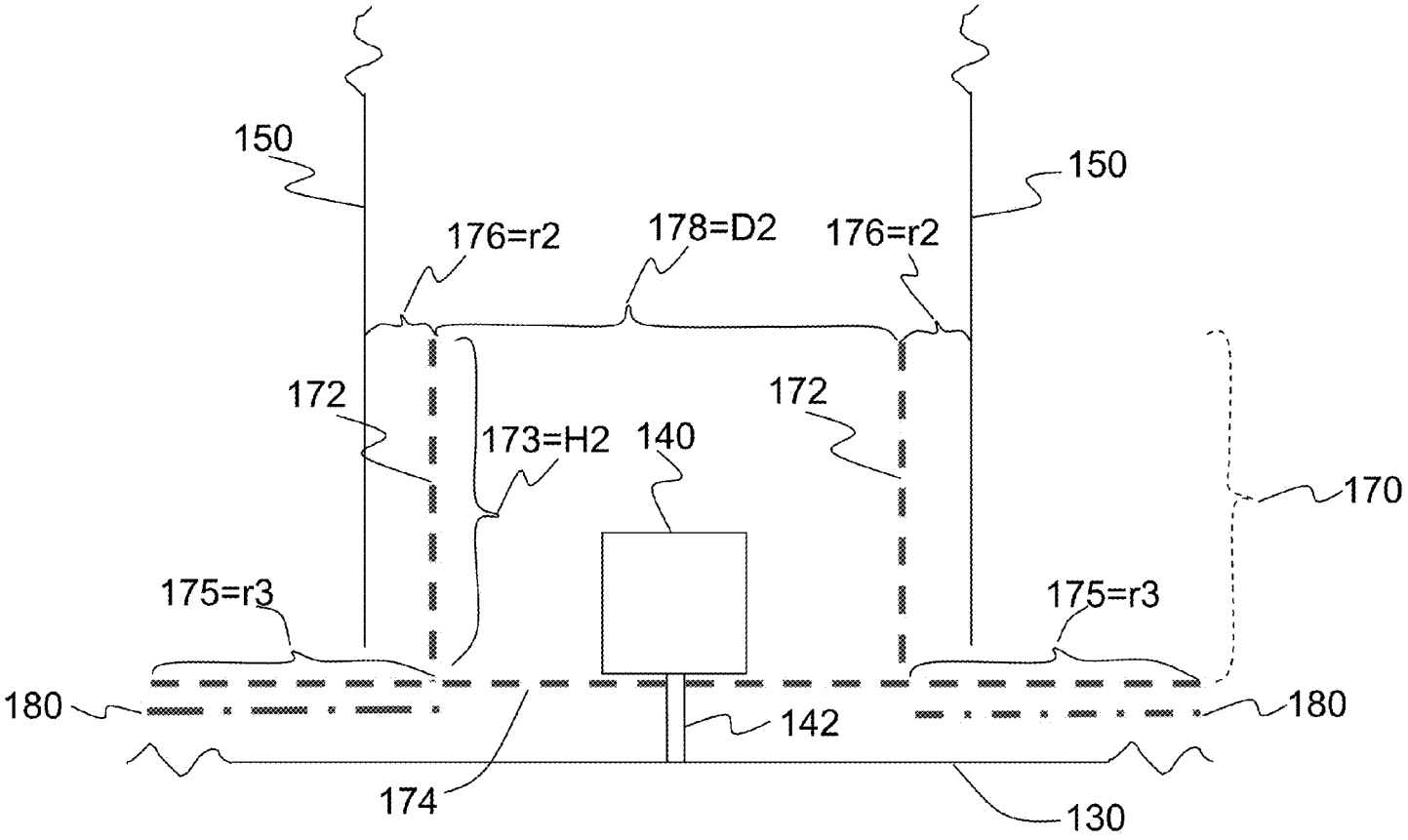
FIG. 1D is a schematic diagram showing a magnified view of the portion of FIG. 1C that contains the invention.

An enlarged view of that portion of FIG. 1C showing the guide protective assembly 170 is shown in FIG. 1D, including a schematic representation of that portion of the mounting assembly 180 that is attached to the guide assembly 170 that protects the operating nut. The guide protective assembly 170 is comprised of a protective guide structure 172 and a mounting collar 174. The protective guide structure 172 fits up inside the riser pipe 150. The guide protective assembly 170 is attached to that portion of mounting assembly 180 that abuts the mounting collar 174 at mounting collar flange 175. The remaining portion (not shown in FIG. 1D) of mounting assembly 180 is attached to the actuator 130. The attachment of the remaining portion of the mounting assembly 180 to the actuator 130 may be accomplished in a variety of ways, as illustrated in preferred embodiments shown in FIGS. 2C and 3D (for a first exemplar implementation) and FIGS. 2D and 4B (for a second exemplar implementation).

Figure 2A:
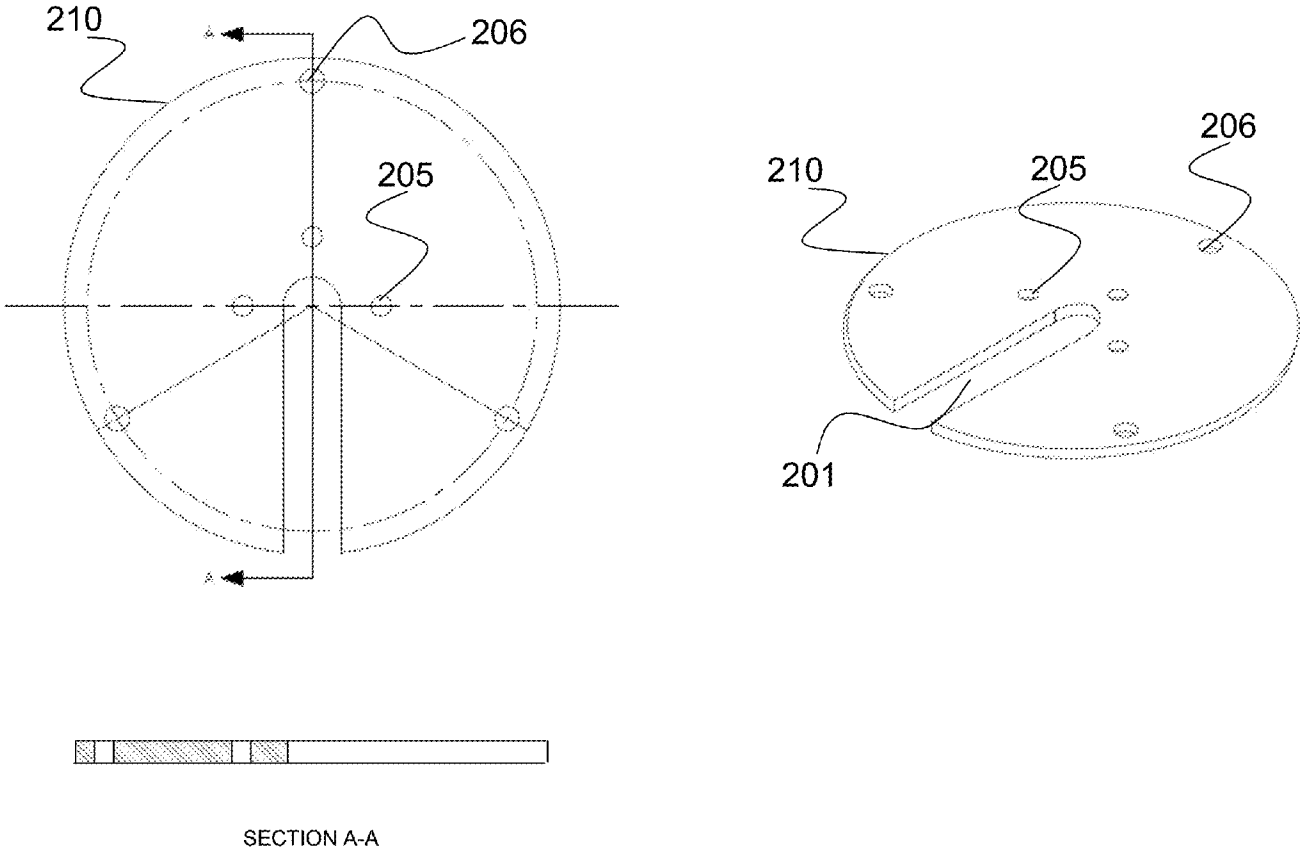
FIG. 2A is a set of drawings for a base plate used as a mounting assembly in a first implementation of the invention.
Figure 2B:
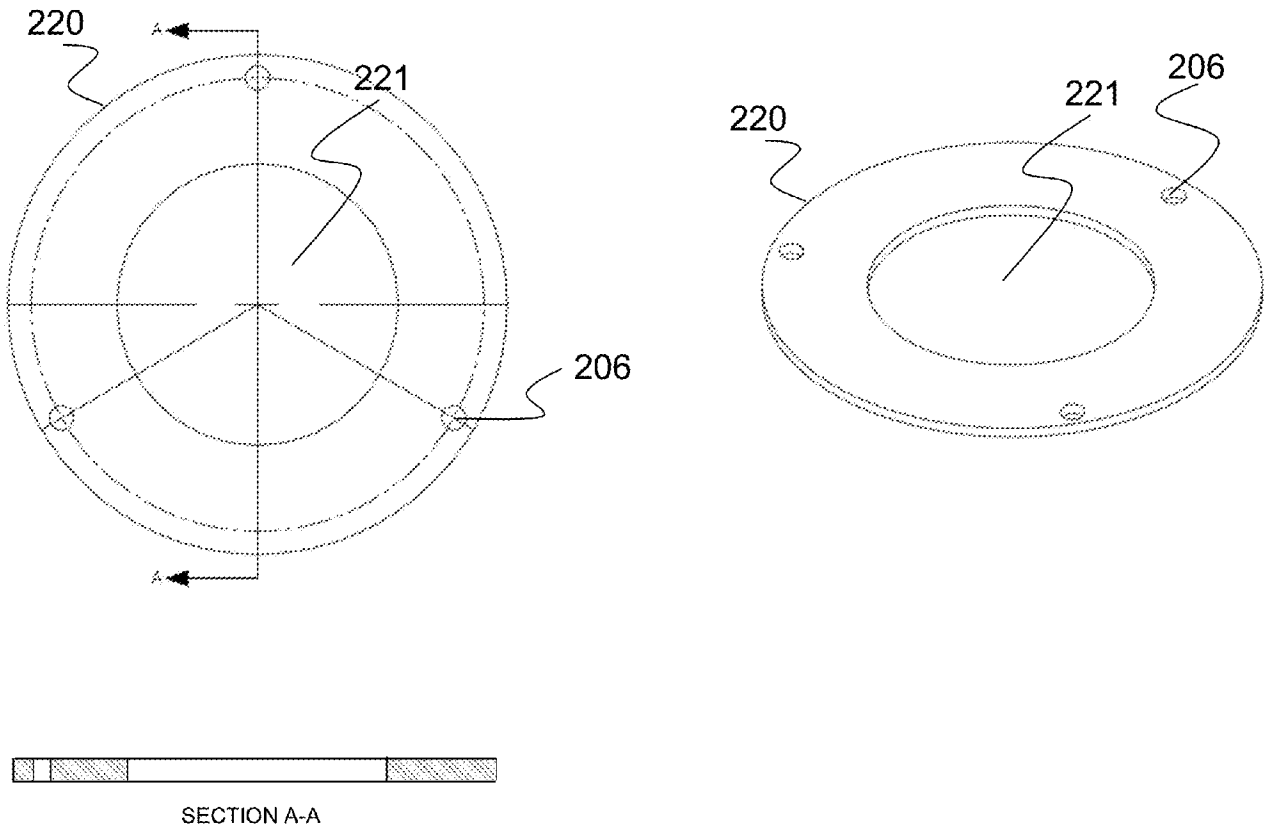
FIG. 2B is a set of drawings for a mounting collar in a first implementation of the invention.
Figure 2C:
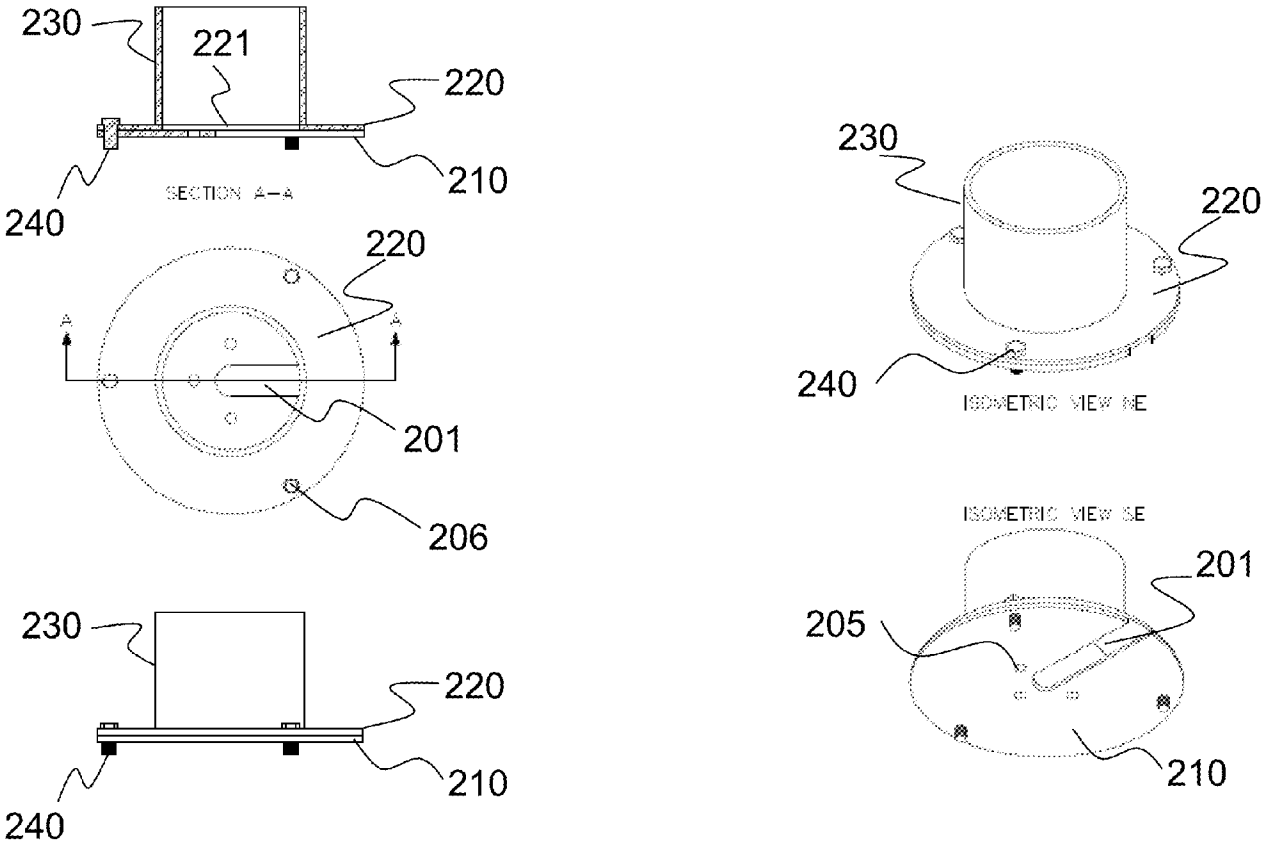
FIG. 2C is a set of drawings of the nut protector as assembled from the guide structure, mounting collar and base plate in accordance with a first implementation of the invention.
Figure 3A:
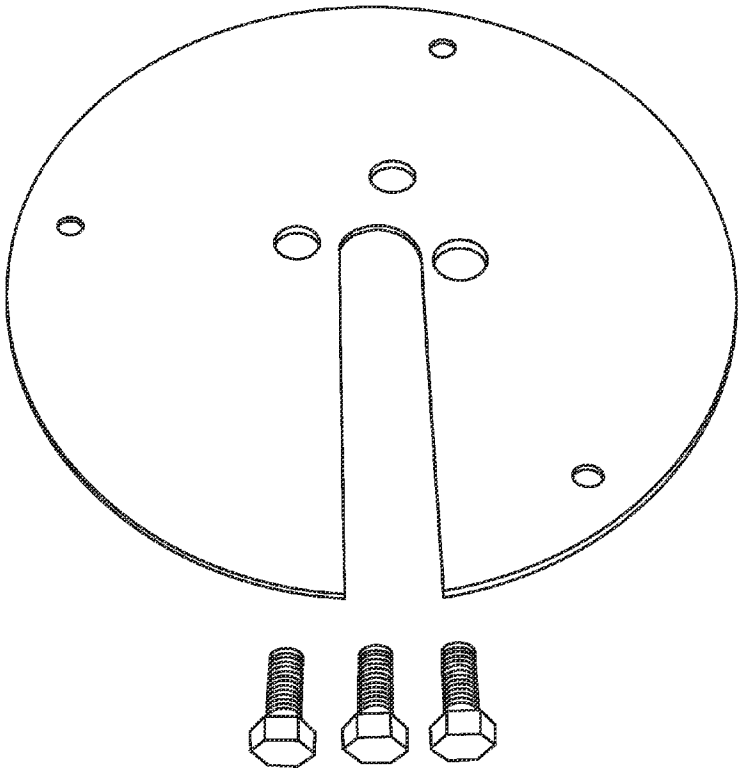
FIG. 3A is a photograph of the base plate used in a first implementation of the nut protector assembly.
Figure 3B:
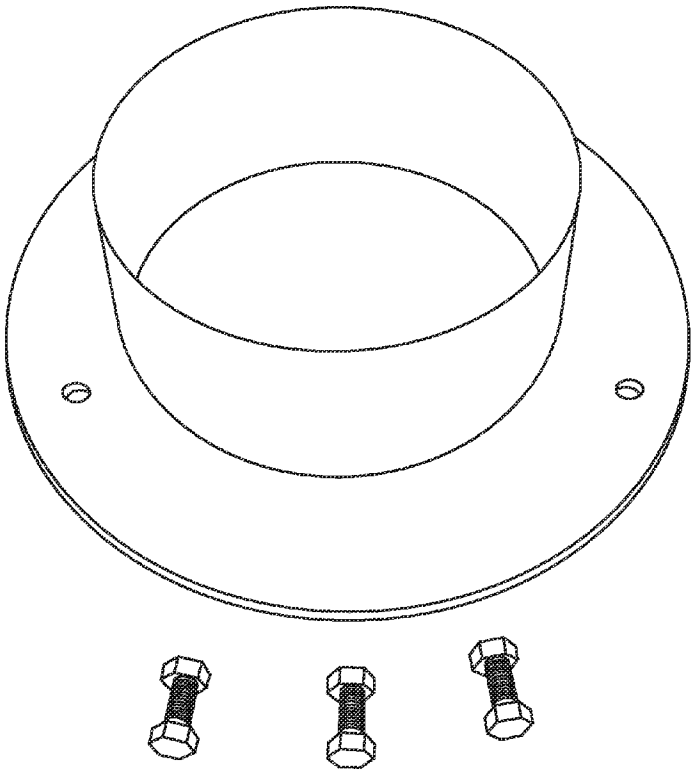
FIG. 3B is a photograph of the guide structure welded to the mounting collar to form a guide protective assembly in used in a first implementation of the invention.
Figure 3C:
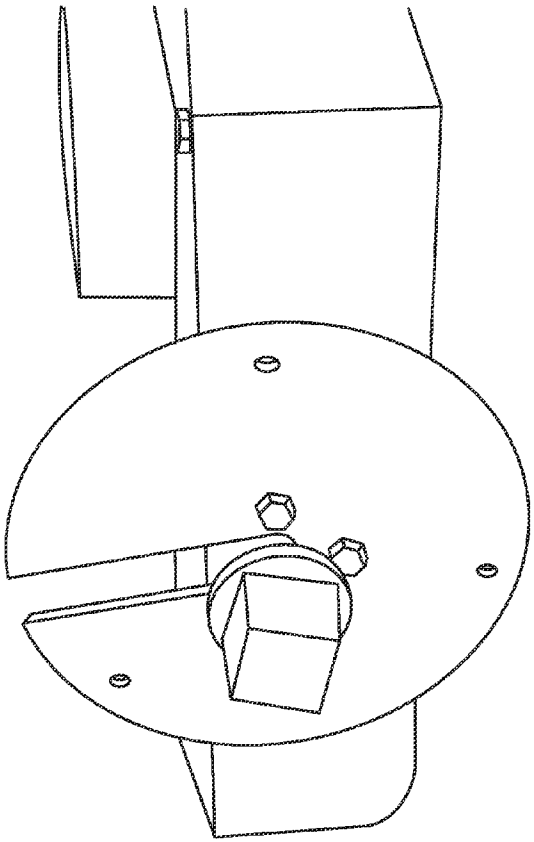
FIG. 3C is a photograph of the base plate of the nut protector assembly, mounted on the actuator and around the operating nut stem between the operating nut and the actuator of the valve assembly.
Figure 3D:
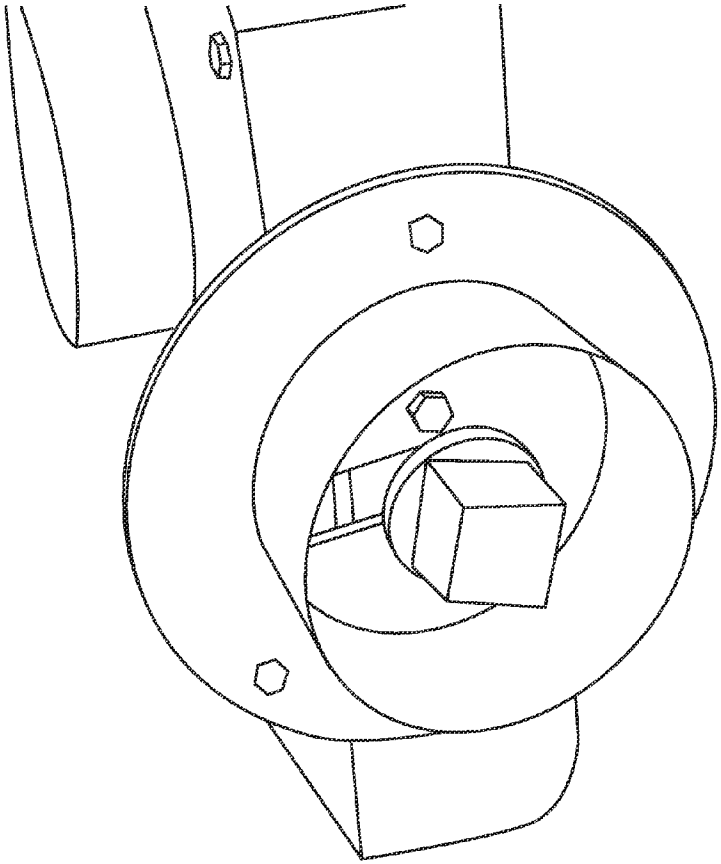
FIG. 3D is a photograph of a guide protective assembly bolted to a base plate to form a nut protector assembly mounted to protect the operating nut.
Figure 4A:
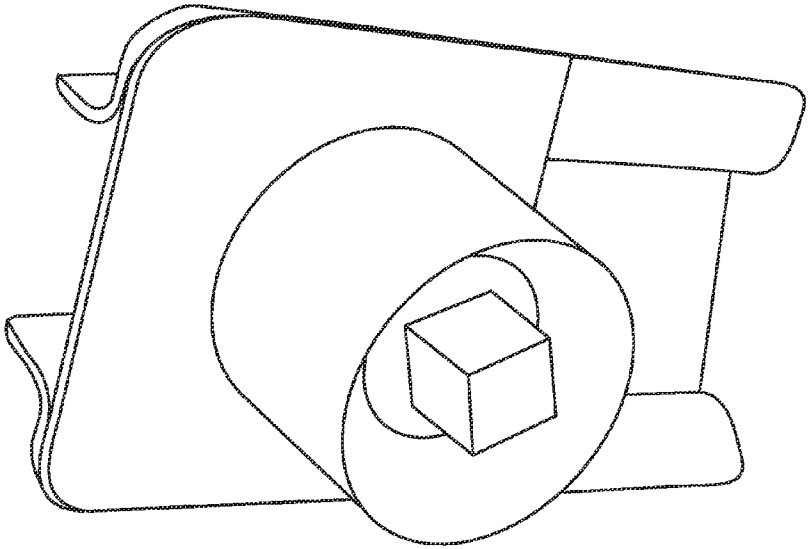
FIG. 4A is a photograph of a top perspective view of a nut protector assembly in accordance with a second implementation of the invention.
Figure 4B:
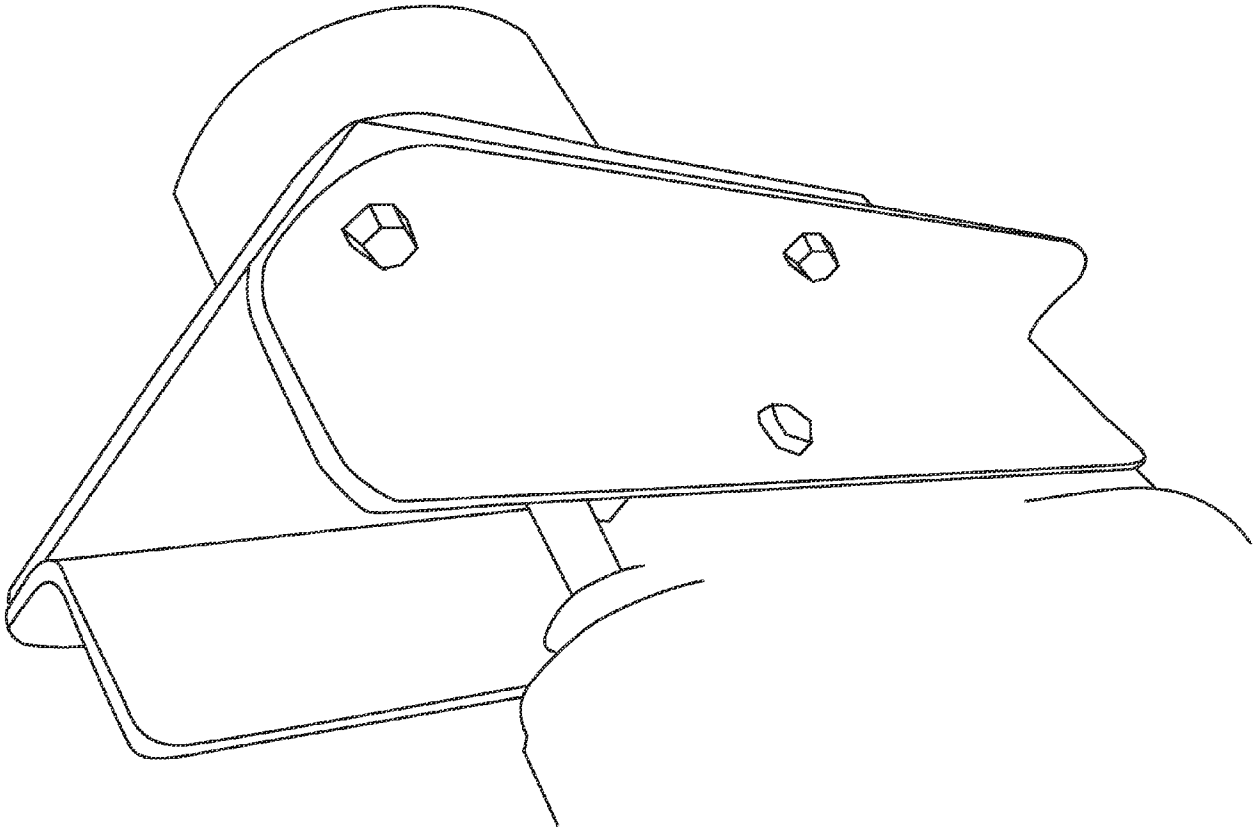
FIG. 4B is a photograph of a perspective view of the underside of the nut protector assembly of FIG. 4A.

Details of a first exemplar implementation of the invention are shown in FIGS. 2A, 2B and 2C. The mounting assembly, base plate 210 as illustrated photographically in FIG. 3A, is installed between the operating nut and the actuator as shown in FIG. 3C by lug bolts through pre-aligned holes 205 having corresponding threaded holes in the actuator. Opening 201 is provided to allow the base plate 210 to be inserted around the stem between the operating nut and the actuator. Then the guide protective assembly is placed over the operating nut through opening 221 and secured to the base plate 210 by bolts 240 through pre-aligned holes 206 in the collar 220 (as shown in FIGS. 2B and 2C) and in the base plate 210 (as shown in FIGS. 2A and 2C). A photographic illustration of the installed nut protector assembly in this first preferred embodiment is shown in FIG. 3D.

In this exemplar configuration the guide protective structure is a cylinder having an outside diameter less than the inside diameter of the riser pipe. The guide protective structure is welded to a mounting collar 220 to form the guide protective assembly, the outermost portion of the mounting collar then providing a flange directed outwardly from the cylinder 230 as shown in FIG. 3B. Those skilled in the art will appreciate that the guide protective assembly can be formed in a single piece as well as by welding two pieces.

Figure 2D:
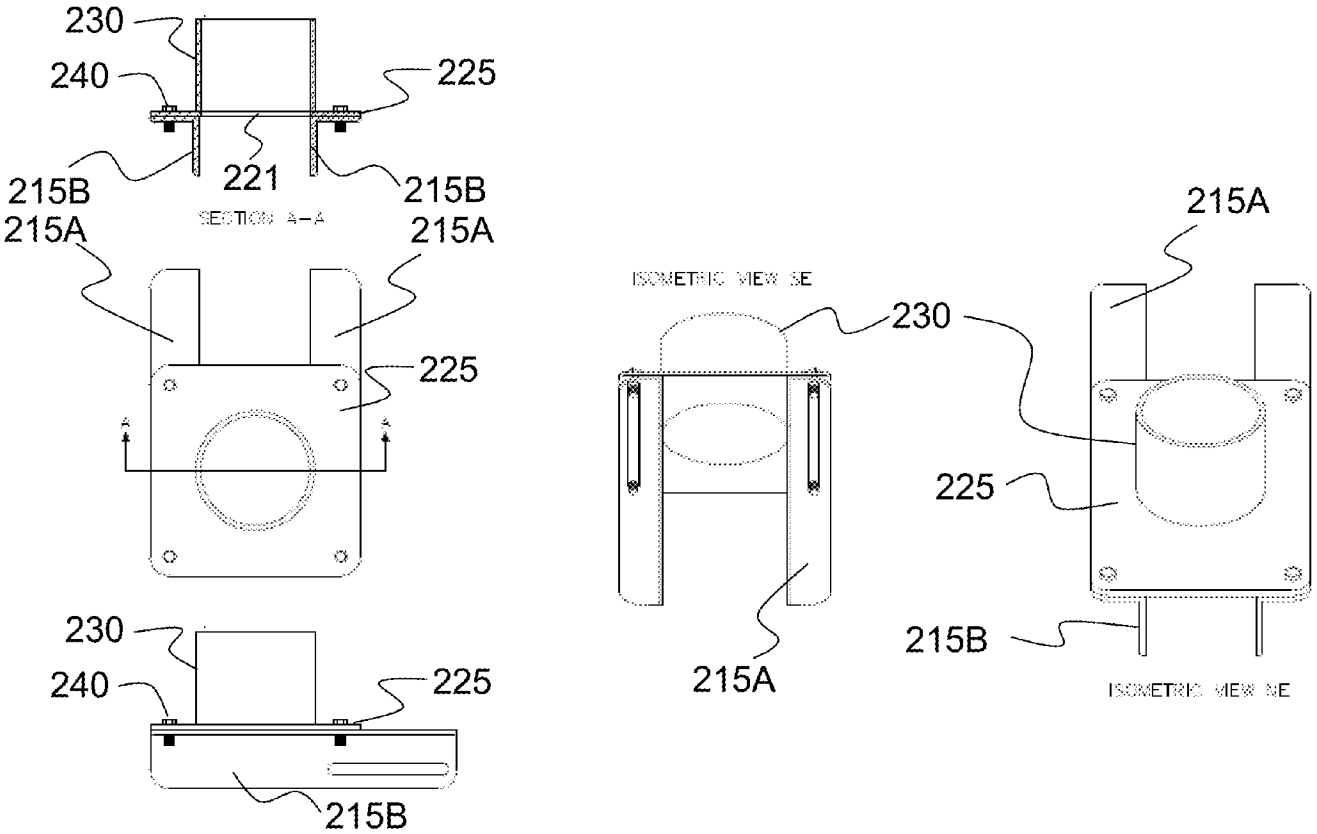
FIG. 2D is a set of drawings of the nut protector as assembled from the guide structure, mounting collar and angle braces in accordance with a second implementation of the invention.

The details of a second exemplar implementation of the invention are shown in FIG. 2D. In this implementation the guide protective assembly is formed of guide protective structure 230 and mounting collar 225 as before, with an outward jutting flange. The mounting assembly is comprised of two angle braces 215 each formed of two segments at ninety degree angles to one another. One segment 215A is attached to the outward jutting flange via bolts 240 as shown in FIG. 2D. Segments 215B are then bolted to the actuator 130 as illustrated photographically in FIG. 4B.

It will be observed that the invention may be installed in a variety of large pipe installations having valves 120, actuators 130 and operating nuts 140. Returning to FIGS. 1C and 1D it will be appreciated by those skilled in the art that the inside diameter 154=D1 of the riser pipe 150 is greater than the outside diameter 178=D2 of the guide protective structure 172. In the preferred embodiments the amount of the difference ($D1-D2=2\cdot r2$) is small, and in any event D2 must be large enough to accommodate the tool placed from above ground down through the riser pipe and over operating nut 140 to turn the nut and open or close the valve 120. For example, in an installation with a 6" diameter riser pipe eight feet in length the amount of play (twice 176=r2) between the guide protective structure 172 and the riser pipe 150 is preferably less than one inch and greater than one-half inch. Having a small amount of play will protect the riser pipe from cracking in the event of lateral ground motion after installation.

As indicated above, the invention protects the operating nut from damage due to motion of the riser pipe either accidentally during construction or from shifting of the ground after installation. At the time of installation an estimate is made as to post installation movement of the riser pipe. At a minimum the guide protective structure (e.g. a cylinder) must protrude (173=H2) at least as far as the nut itself. For a two-inch operating nut, this means a minimum of two inches (i.e. H2=2"). In addition, allowance must be made for vertical shifting of the riser pipe. In a typical installation involving an eight foot length (152=H1) of 6" riser pipe, this consideration could call for a minimum guide protective structure several inches higher (e.g. H2=4"). In such a typical installation, the width of the flange (175=r3) is preferably between two and three inches, and may be larger if necessary to accommodate the mounting requirements of the actuator 130. Those skilled in the art will appreciate that the above dimensions are exemplary, and that utility installations may have a variety of diameters and lengths of riser pipe and a variety of ground installations affecting the assessment of potential riser pipe movement post installation.

While the invention has been described in terms of preferred embodiments, those skilled in the art will recognize that the invention can be practiced with modification within the spirit and scope of the appended claims.

Having thus described our invention, what we claim as new and desire to secure by Letters Patent is as follows:

1. An apparatus for protecting an operating nut of an actuator that controls a valve in an underground pipe, comprising:

a guide assembly formed of a hollow guide structure and a mounting collar, the guide structure fitting inside a lower end of a riser pipe and providing a barrier between the riser pipe and the operating nut, the riser pipe providing access from an above ground location to the operating nut along a main axis, the mounting collar being in a plane perpendicular to the main axis and being joined to a lower edge of the guide structure and jutting outwardly from said guide structure, the outward jutting portion of the mounting collar being a flange; and a mounting assembly having a first portion joined to said flange and having a second portion bolted directly to said actuator.

2. The apparatus as in claim 1, wherein the mounting collar is joined to the guide structure by a weld along the lower edge of the guide structure.

3. The apparatus as in claim 1, wherein the guide structure and the mounting collar are formed as a single piece.

4. The apparatus as in claim 1, wherein a height of the guide structure along the main axis is a height of the operating nut plus an estimated amount allowing for movement of the riser pipe along the main axis.

5. The apparatus as in claim 1, wherein the first portion of the mounting assembly is a planar surface abutting an underside of said flange and is joined to said flange by being bolted to said flange.

6. The apparatus as in claim 5, wherein the mounting assembly is a base plate having a cutout so that the base plate can be inserted behind the operating nut and over a stem connecting the operating nut to the actuator.

7. The apparatus as in claim 6, wherein the base plate is joined to the actuator by bolts running parallel to the main axis.

8. The apparatus as in claim 7, wherein the bolts joining the base plate to the actuator are within an area on the base plate formed by projecting the lower edge of the guide structure onto the base plate.

9. The apparatus as in claim 5, wherein the mounting assembly is a first angle iron and a second angle iron oriented parallel to one another, each having a first segment bolted to said flange and a second segment perpendicular to the flange bolted to the actuator.

10. The apparatus as in claim 9, wherein each of the second segments of the first and second angle irons are positioned on opposite sides of the actuator.

11. A method for protecting an operating nut of an actuator that controls a valve in an underground pipe, comprising:

forming a guide assembly from a hollow guide structure and a mounting collar, the guide structure fitting inside a lower end of a riser pipe and providing a barrier between the riser pipe and the operating nut, the riser pipe providing access from an above ground location to the operating nut along a main axis, the mounting collar being in a plane perpendicular to the main axis and being joined to a lower edge of the guide structure and jutting outwardly from said guide structure, the outward jutting portion of the mounting collar being a flange;

forming a mounting assembly having a first portion for joining to said flange and a second portion for being bolted directly to said actuator; and joining the guide assembly and the mounting assembly.

12. The method as in claim 11, wherein the guide assembly is formed by welding the mounting collar to the guide structure along the lower edge of the guide structure.

13. The method as in claim 11, wherein the guide structure and the mounting collar are formed as a single piece.

14. The method as in claim 11, wherein a height of the guide structure along the main axis is a height of the operating nut plus an estimated amount allowing for movement of the riser pipe along the main axis.

15. The method as in claim 11, wherein the first portion of the mounting assembly is a planar surface abutting an underside of said flange.

16. The method as in claim 15, wherein the mounting assembly is a base plate having a cutout so that the base plate can be inserted behind the operating nut and over a stem connecting the operating nut to the actuator, and wherein joining the guide assembly and the mounting assembly further comprises:

inserting the base plate over the stem;

bolting the base plate to the actuator;

aligning the guide assembly over the base plate; and bolting the guide assembly to the base plate.

17. The method as in claim 16, wherein a plurality of bolts joining the base plate to the actuator run parallel to the main axis.

18. The method as in claim 17, wherein the plurality of bolts joining the base plate to the actuator are within an area on the base plate formed by projecting the lower edge of the guide structure onto the base plate.

19. The method as in claim 15, wherein the mounting assembly is a first angle iron and a second angle iron oriented parallel to one another, each having a first segment for bolting to said flange and a second segment perpendicular to the flange for bolting to the actuator.

20. The method as in claim 19, further comprising:

bolting each said first segment to said flange; and bolting each said second segment to the actuator, wherein each of the second segments of the first and second angle irons are positioned on opposite sides of the actuator.

* * * * *